US006000979A

United States Patent [19]

Stewart

[11] Patent Number: 6,000,979

[45] **Date of Patent: *Dec. 14, 1999**

[54] LEASH FOR AN AQUATIC SURFCRAFT

[76] Inventor: Michael Stewart, 6915 Shorecrest Dr., Anaheim, Calif. 92802

[ * ] Notice: Under 35 U.S.C. 154(b), the term of this patent shall be extended for 632 days.

[21] Appl. No.: 08/772,336

[22] Filed: Dec. 23, 1996

Related U.S. Application Data

[63] Continuation of application No. 08/702,208, Aug. 23, 1996, which is a continuation of application No. 08/379,083, Aug. 15, 1995, which is a division of application No. 08/258,563, Jun. 10, 1994.

[51] Int. Cl.[6] ..... B63B 1/00

[52] U.S. Cl. ..... 441/75; 119/795

[58] Field of Search ..... 441/74, 75, 85; 119/769, 770, 787, 792, 795, 797, 798

[56] References Cited

U.S. PATENT DOCUMENTS

| | | | |
|---|---|---|---|
| 2,911,947 | 11/1959 | Kramer | 119/109 |
| 3,003,018 | 10/1961 | Cook | 174/69 |
| 3,397,482 | 8/1968 | Bibeau et al. | 119/96 |
| 4,037,442 | 7/1977 | Staude et al. | 224/219 |
| 4,479,785 | 10/1984 | Tugwood et al. | 441/75 |
| 5,080,045 | 1/1992 | Reese et al. | 119/795 |
| 5,324,220 | 6/1994 | Stewart | 441/75 |

FOREIGN PATENT DOCUMENTS

| | | | |
|---|---|---|---|
| 2675013 | 10/1992 | France | 119/798 |

*Primary Examiner*—Jesus D. Sotelo
*Attorney, Agent, or Firm*—Blakely Sokoloff Taylor & Zafman

[57] ABSTRACT

A strap for the leash of an aquatic surfcraft such as a bodyboard or a surfboard. The strap has an inner foam pad sewn to a flexible base member. Also sewn to the base member are a pair of strips that have cooperating hook and loop material, which allow the strap to be folded and fastened to an appendage of the user. The strap is typically coupled to a leash by a swivel joint that is mounted to a joint housing which extends from the base member. The base member has a plurality of apertures configured so that the base member bends and conforms to the appendage of the user.

4 Claims, 3 Drawing Sheets

FIG. 1
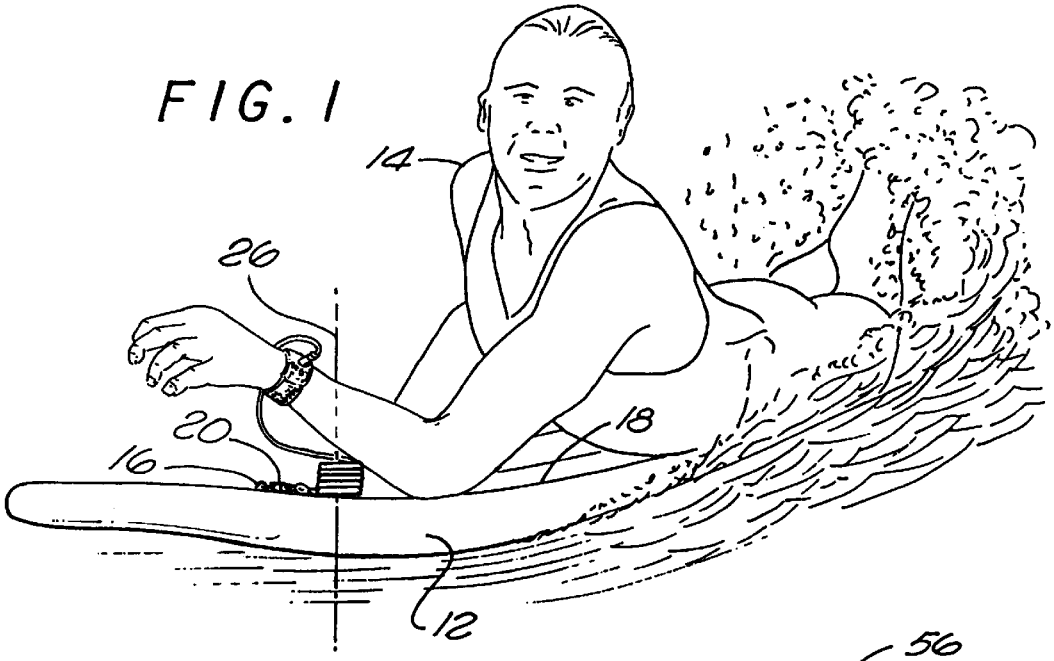
FIG. 2
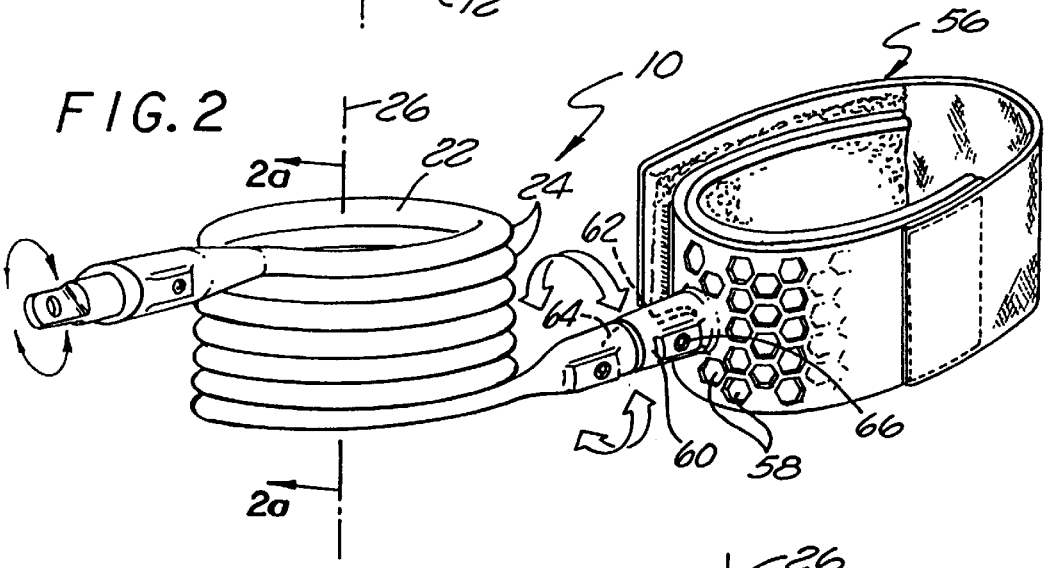
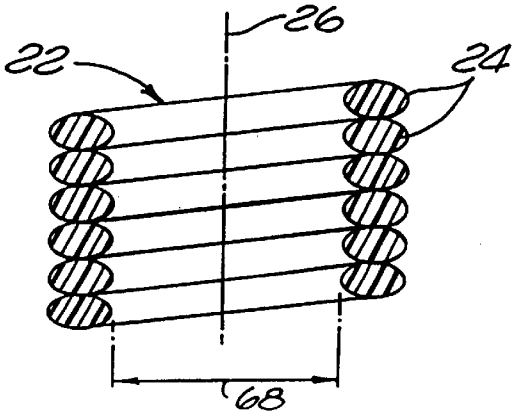
FIG. 2a

LEASH FOR AN AQUATIC SURFCRAFT

This is a Continuation application of application Ser. No. 08/702,208, filed Aug. 23, 1996, which is a continuation application of application Ser. No. 08/379,083, filed Aug. 15, 1995, which is a divisional application of application Ser. No. 08/258,563, filed Jun. 10, 1994.

BACKGROUND OF THE INVENTION

1. Field of the Invention

The present invention relates to leashes used to attach a rider to a bodyboard or surfboard.

2. Description of Related Art

Bodyboards typically have a leash that allows the rider to maintain constant possession of the board. The leash usually includes a wrist strap that is coupled to the board by a cord or wire. Different wave conditions require different lengths of cord. For example, while waiting for the "perfect" wave, the rider may dive beneath the turbulence to avoid movement from the water. The board is left on the surface of the water, wherein the leash serves to prevent the board from floating away from the user. For large waves, the rider must dive particularly deep to avoid the wave turbulence. Therefore large waves typically require a longer cord.

U.S. Pat. No. 4,610,634 issued to Kimura and U.S. Pat. No. 4,041,562 issued to Nealy, disclose leashes that have a cord attached to an ankle strap. Although the cord of these devices can be long enough to use in large waves, the longer wire can become entangled with the user.

U.S. Pat. No. 4,044,415 issued to Wood, discloses a leash with an elastic member that stretches to increase the length of the cord. The Wood leash is still susceptible to entanglement and provides only limited variations in cord length.

U.S. Pat. No. 4,479,785 issued to Tugwood et al, discloses a leash with a helical cord. The cord varies in length as the user moves farther from the board. The cord extends parallel with the surface of the board and thus can still become a source of entanglement. Additionally, a rider will typically lie flat on the board while riding the waves. The rider may inadvertently lie on the cord. The thickness of the helical cord, when pinned beneath the user, can cause discomfort and pain.

Depending upon location and weather, the user may be subjected to various wave conditions. Some waves may necessitate a long leash, while other conditions may require a short leash. It would be desirable to provide a leash that can be readily attached to another leash, to quickly increase the length of the same. It would also be desirable to have a leash that can vary in length, while not being susceptible to entanglement with the user.

SUMMARY OF THE INVENTION

The present invention is a strap for the leash of an aquatic surfcraft such as a bodyboard or a surfboard. The strap has an inner foam pad sewn to a flexible base member. Also sewn to the base member are a pair of strips that have cooperating hook and loop material, which allow the strap to be folded and fastened to an appendage of the user. The strap is typically coupled to a leash by a swivel joint that is mounted to a joint housing which extends from the base member. The base member has a plurality of apertures configured so that the base member bends and conforms to the appendage of the user.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a perspective view of a leash attached to a bodyboard and a rider;

FIG. 2 is a perspective view of a coil and a wrist strap;

FIG. 2*a* is a cross-sectional view of the coil of FIG. 2, taken at line 2*a*—2*a;*

DETAILED DESCRIPTION OF THE INVENTION

Figure 3:
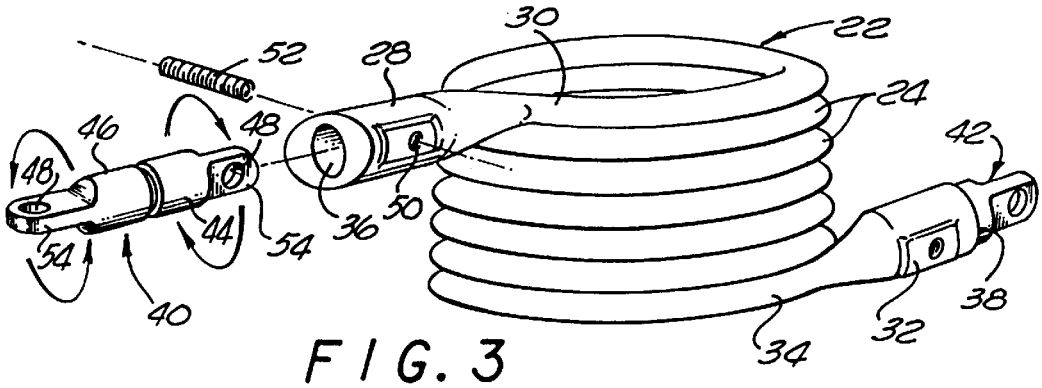
FIG. 3 is an exploded view of the coil and swivel joints.

Referring to the drawings more particularly by reference numbers, FIG. 1 shows a leash 10 of the present invention attached to a bodyboard 12 and a rider 14. The bodyboard 12 typically has a stud 16 extending from the surface 18 of the board and a wire or cord 20 tied to the stud 16. Although a stud 16 is described, it is to be understood that another type of attachment means may be used to connect the cord 20 to the board 12. The leash 10 couples the rider 14 to the bodyboard 12, so that the rider 14 may retrieve the board 12 in the event the two become separated.

As shown in FIG. 2, the leash 10 has a coil 22. The coil 22 has a plurality of loops 24 that are adjacent to each other. As shown in FIG. 2*a*, the loops 24 preferably have an elliptical cross-section to reduce the overall height of the coil 22. The elliptical cross-section also decreases aerodynamic drag when the coil 22 is extended. The coil 22 is preferably constructed from urethane having a durometer of 55D. It has been found that 55D durometer urethane provides optimum flexibility, strength and resiliency for use in a bodyboard leash. When the board becomes separated from the rider, it is desirable to quickly pull the board back for further use. 55D durometer has been found to be resilient and strong enough to quickly pull the board back, and yet flexible enough to not shock the rider when the two become separated.

The loops 24 form a cylindrical shaped coil that has a longitudinal axis 26. As shown in FIG. 1, the coil 22 is attached to the bodyboard 12 so that the longitudinal axis 26 is perpendicular to the surface 18 of the board 12. This orientation reduces the amount of surface area occupied by the coil 22. When the rider is paddling, he is typically lying flat on the surface of the board 12. By minimizing the surface area of the coil 22, the user is less likely to lie on top of the leash. Additionally, the loops 24 are constructed to expand and contract, so that there is always tension in the coil 22. This constant tension prevents any excess coil 22 from becoming entangled with the rider 14.

As shown in FIG. 3, the coil 22 has a first housing 28 on a first end 30 of the coil and a second housing 32 on a second end 34 of the coil. The housings 28 and 32 are preferably molded with the loops 24. The integration of the housings with the coil, increases the overall strength of the leash 10. The first 28 and second 32 housings have first 36 and second 38 sockets, respectively. Attached to the housings are first 40 and second 42 swivel joints. Each swivel joint has a first portion 44 that fits within the sockets. Extending from the first portions 44 are second portions 46 that are adapted to rotate 360 degrees relative to the first portions 44 and the coil 22. Both portions of the swivel joints have apertures 48. The cord 20 can be tied to the second portion 44 of the first swivel joint 40, thereby attaching the coil 22 to the board 12.

The housings have apertures 50 that allows set screws 52 to be threaded into the housings. The screws 52 pass through the apertures 48 of the first portions 44, thereby attaching the joints to the housings and coil. The housings 28 and 32 preferably have an elliptical cross-section. The screws extend through the length of the ellipse, to provide an optimum amount of thread within the aperture 50. The apertures 50 can be self tapping, wherein the first installation of the screws create the threads within the housings. Each portion 44 and 46 of the joints may have tongues 54 formed therein. The shape of the tongues 54 match slots (not shown) formed within the sockets, to key the swivel joints with the housing. This keying feature aligns the apertures of the first portions and the housings, so that the screws can be easily inserted therein. Although set screws 52 are described and shown, it is to be understood that other attachment means may be used, such as a pin.

As shown in FIG. 2, the coil 22 is attached to a wrist strap 56. The strap 56 is constructed as one piece and preferably has hook and loop material to provide an easy means of attaching and detaching the strap 56 to the wrist of the rider. The strap 56 has a plurality of hexagonal shaped apertures 58 that reduce the weight of the strap 56, without significantly decreasing the strength of the same. Extending from the strap 56 is a housing 60 with a socket 62, aperture 64 and screw 66 as described above. The strap 56 is attached to the coil 22, by inserting the second portion 46 of the second swivel joint 42 into the socket 62 of the strap housing 60, and then screwing the set screw 66 into the housing 60 and through the aperture 48 of the second portion 46. The strap 56 is attached directly to the coil 22 without any intermediary ropes or loops. Providing the strap close to the coil, decreases the possibility of entanglement, particularly while the rider is paddling on the board.

The second portions 46 are preferably longer than the first portions 44 and the sockets, so that part of the second portion extends from the housing. With this socket/joint relationship the universal joint (not shown) of the swivel is never constrained by the housing, wherein the second portion 46 can always rotate relative to the first portion 44. This insures easy movement between the coil 22 and the strap 56, and the coil 22 and the board 12. The inner diameter 68 of the coil 22 and the width of the strap 56 are of such dimension that the strap 56 can be pulled through the coil 22. After extended use the coil 22 will sometimes obtain a semi-permanent stretched position. It has been found that by pulling the strap 56 through the coil 22, the coil 22 will return to the fully retracted flattened position.

Figure 4:
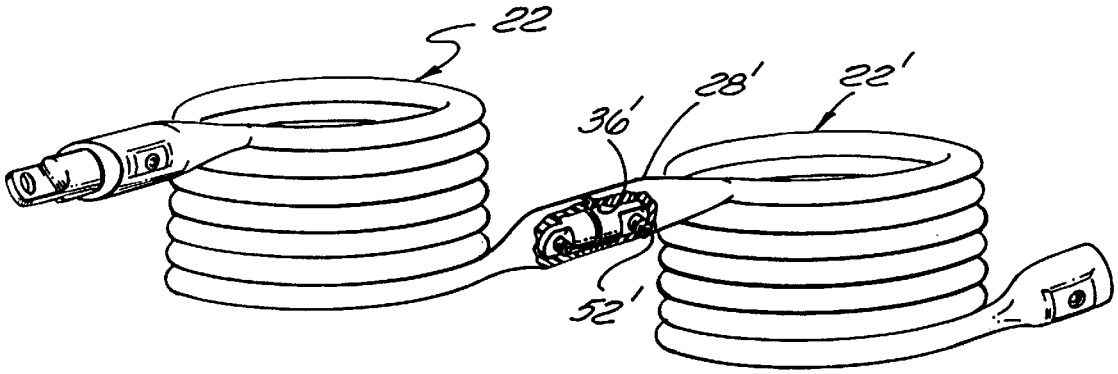
FIG. 4 is a perspective view showing one coil being attached to another coil.

As shown in FIG. 4, a second coil 22' can be connected to the first coil 22 to increase the length of the leash 10. To connect the coils, the strap 56 is initially detached from the first coil 22. The first swivel joint (not shown) is removed from the first housing 28' of the second coil 22'. The second portion 46 of the second joint 42 of the first coil 22 is then inserted into the socket 36' of the second coil 22'. A set screw 52' is screwed into the housing 28', thereby attaching the swivel joint 42 to the housing 28' and the second coil 22' to the first coil 22. The same procedure can be used to connect additional coils, wherein the user can vary the length of the leash. Although the above process was described by removing a swivel joint from the second coil, it is to be understood that the coils can be connected in the same manner by removing the second swivel joint 42 from the first coil 22.

Figure 5:
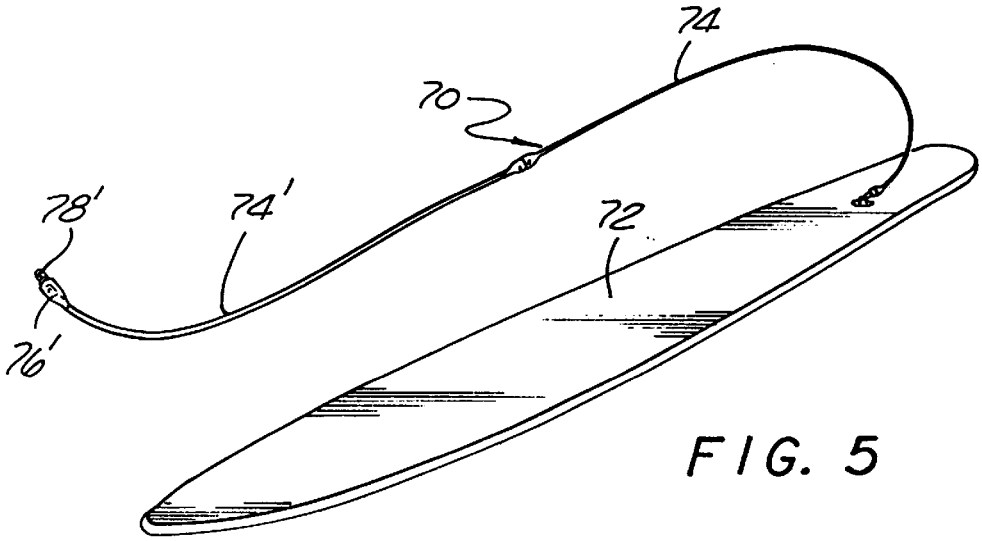
FIG. 5 is a perspective view showing one wire-leash being connected to another wire-leash.

FIG. 5 shows another embodiment of a leash 70 that is typically used with a surfboard 72. The leash 70 incorporates a straight wire 74 instead of a coil 22. It being felt that the pull of the spring-coil 22 would be undesirable to the user of a surfboard. The wire is typically attached to an ankle strap (not shown). The ends of wire 74 have housings 76' and swivel joints 78' as described above. The swivel joints and housings allow additional wires 74' to be connected to increase the overall length of the leash 10.

Figure 6:
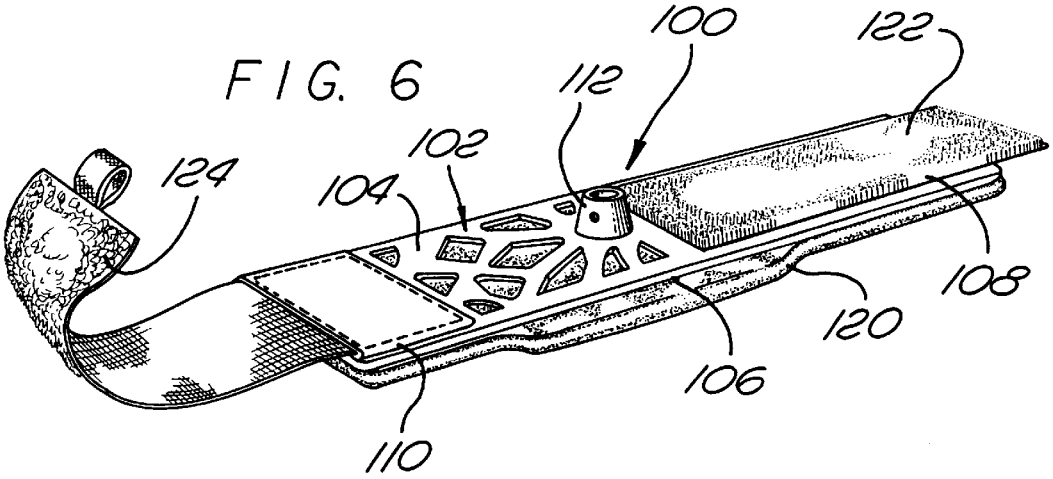
FIG. 6 is a perspective view of a strap.
Figure 7:
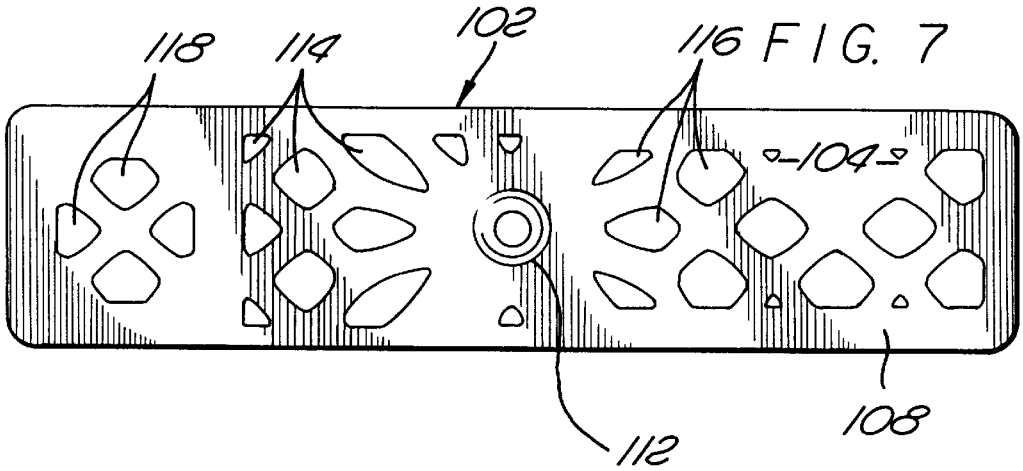
FIG. 7 is a top view of a base member of the strap.

FIGS. 6 and 7 show a strap 100 of the present invention. As shown in FIG. 7, the strap 100 has a base member 102 which has a first surface 104 and an opposite second surface 106, a first end section 108 and a second opposite end section 110. Extending from the first surface 104 of the base member 102 is a joint housing 112 that houses the swivel joint shown and described above. Adjacent to the housing joint 112 are a plurality of first holes 114 in the first end section 108. The base member 102 also has a plurality of second holes 116 in the second end section 110 adjacent to the housing 112. The base member 102 may also have a number of secondary holes 118 on both end sections 108 and 110, which reduce the weight and increase the flexibility of the strap 100. The base member 102 is typically constructed from a flexible plastic material.

As shown in FIG. 6, the strap 100 preferably has a foam pad 120 attached to the second surface 106 of the base member 102. The foam pad 120 increases the comfort of wearing the strap 100. The strap 100 also has a strip of hook material 122 sewn into the first end section 108, in a manner that exposes the first holes 114. The strap 100 also has a strip of loop material 124 sewn into the second end section 110, such that the second holes 116 are covered by the strip 124.

Figure 8:
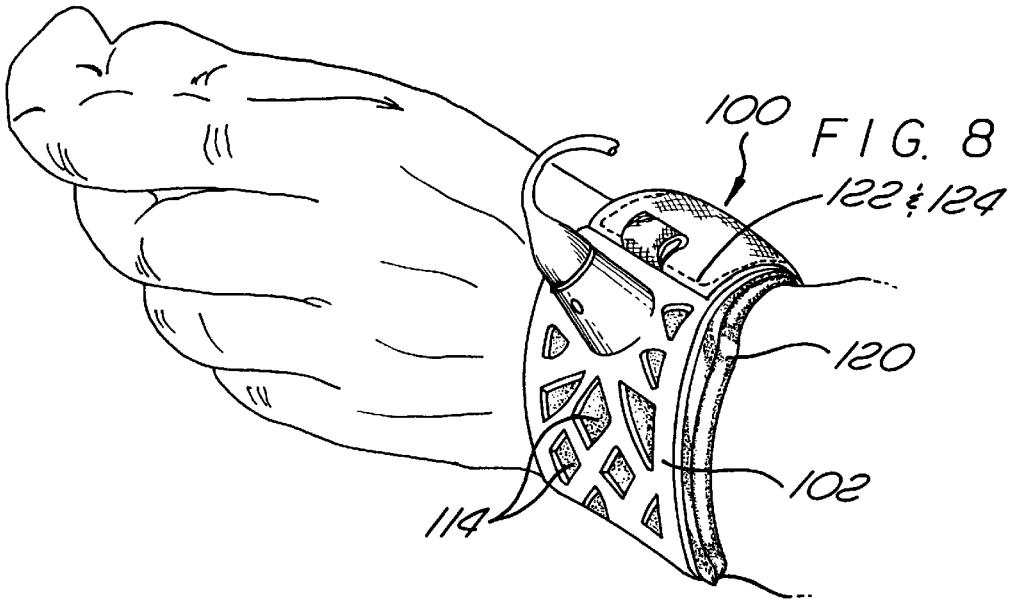
FIG. 8 is a perspective of the strap attached to an appendage of a user.

As shown in FIG. 8, the strap 100 is worn by wrapping the base member 102 about an appendage of the user and attaching the strip of hook material 122 to the strip of loop material 124. The exposed first holes 114 provide a weakened section of the base member 102 which bends and allows the strap 100 to conform to the shape of the appendage. The conformal shape of the base member 102 provides a strap 100 that is more comfortable to wear and use.

The joint housing 112 is offset from the center of the strap area that has the exposed first holes 114, so that the housing 112 is located at the upper portion of the user's wrist, as shown in FIG. 8. Locating the housing 112 at the upper portion of the user's wrist creates a tension in the coil 22 and prevents the user from becoming entangled with the coil 22. Additionally, the upper housing location prevents the housing 112 from striking the board 12 and causing discomfort when the user is paddling.

While certain exemplary embodiments have been described in detail and shown in the accompanying drawings, it is to be understood that such embodiments are merely illustrative of and not restrictive on the present invention and that the invention not be limited to the specific arrangements and constructions shown and described, since various other modifications may occur to those ordinarily skilled in the art.

What is claimed is:

1. A leash for a bodyboard, comprising:

a first coil having a plurality of loops each adjacent to each other and forming a cylinder having an inner diameter; and, a flexible strap that is coupled to said first coil and which has a width and a flexibility such that said coil can be reversed by pulling said strap through said inner diameter of said coil while said coil is in a relaxed position.

2. The leash as recited in claim 1, wherein said strap has a plurality of hexagonal shaped apertures.

3. The leash as recited in claim 1, wherein said first coil has an elliptical cross-section.

4. The leash as recited in claim 1, wherein said first coil is constructed from urethane having a durometer of 55D.

* * * * *